US009822423B2

(12) United States Patent
Hei et al.

(10) Patent No.: US 9,822,423 B2
(45) Date of Patent: Nov. 21, 2017

(54) METHOD FOR PRODUCING SILICON STEEL NORMALIZING SUBSTRATE

(75) Inventors: Hongxu Hei, Shanghai (CN); Bo Wang, Shanghai (CN); Shishu Xie, Shanghai (CN); Xiandong Liu, Shanghai (CN); Guohua Yang, Shanghai (CN); Yongjie Yang, Shanghai (CN); Aihua Ma, Shanghai (CN); Xiaolin Li, Shanghai (CN); Liang Zou, Shanghai (CN); Huawei Zhang, Shanghai (CN)

(73) Assignee: Baoshan Iron & Steel, Co., Ltd., Shanghai (CN)

( * ) Notice: Subject to any disclaimer, the term of this patent is extended or adjusted under 35 U.S.C. 154(b) by 610 days.

(21) Appl. No.: 14/379,777

(22) PCT Filed: Mar. 26, 2012

(86) PCT No.: PCT/CN2012/000367
§ 371 (c)(1),
(2), (4) Date: Aug. 20, 2014

(87) PCT Pub. No.: WO2013/131211
PCT Pub. Date: Sep. 12, 2013

(65) Prior Publication Data

US 2015/0013847 A1 Jan. 15, 2015

(30) Foreign Application Priority Data

Mar. 9, 2012 (CN) ..... 2012 1 0062502

(51) Int. Cl.

| | |
|---|---|
| ***C21D 1/00*** | (2006.01) |
| ***C21D 8/12*** | (2006.01) |
| ***C21D 1/76*** | (2006.01) |
| ***C21D 6/00*** | (2006.01) |
| ***C21D 1/34*** | (2006.01) |
| ***H01F 41/00*** | (2006.01) |
| ***C21D 9/46*** | (2006.01) |
| ***C21D 1/28*** | (2006.01) |

(52) U.S. Cl.
CPC ..... *C21D 8/1261* (2013.01); *C21D 1/28* (2013.01); *C21D 1/34* (2013.01); *C21D 1/76* (2013.01); *C21D 6/008* (2013.01); *C21D 9/46* (2013.01); *H01F 41/00* (2013.01); *C21D 8/1222* (2013.01); *C21D 8/1233* (2013.01)

(58) Field of Classification Search
CPC ..... C21D 8/1261; C21D 9/561; C21D 1/34; C21D 1/28; C21D 9/46; C21D 1/76; C21D 6/008; C21D 8/1222; C21D 8/1233; H01F 41/00
USPC ..... 148/110–113
See application file for complete search history.

(56) References Cited

U.S. PATENT DOCUMENTS

| | | | | | |
|---|---|---|---|---|---|
| 2,669,442 | A * | 2/1954 | Erhardt, Jr. | C21D 9/561 | 266/110 |
| 3,105,782 | A * | 10/1963 | Walter | C21D 8/1272 | 148/111 |
| 3,307,981 | A * | 3/1967 | Katsahias | C21D 9/52 | 148/287 |
| 3,756,868 | A * | 9/1973 | Bloom | C21D 1/74 | 148/112 |
| 3,778,221 | A * | 12/1973 | Bloom | C21D 1/74 | 266/250 |
| 4,268,326 | A * | 5/1981 | Iwayama | C21D 3/04 | 148/111 |
| 5,302,213 | A * | 4/1994 | Bonner | C21D 1/76 | 148/206 |
| 5,354,389 | A * | 10/1994 | Arai | C22C 38/02 | 148/111 |
| 5,620,533 | A * | 4/1997 | Kotani | C21D 3/04 | 148/111 |
| 5,807,441 | A * | 9/1998 | Tomida | H01F 1/14775 | 148/113 |
| 6,180,933 | B1 * | 1/2001 | Demidovitch | H05B 6/067 | 219/645 |
| 6,395,104 | B1 * | 5/2002 | Kosuge | C21D 3/04 | 148/113 |
| 6,612,154 | B1 * | 9/2003 | Blumenthal | F27B 5/04 | 148/112 |
| 7,037,464 | B2 * | 5/2006 | Ohtsuka | C21D 7/13 | 419/19 |

(Continued)

FOREIGN PATENT DOCUMENTS

| | | | | | |
|---|---|---|---|---|---|
| BE | 1014997 | A3 * | 8/2004 | C23C 2/02 | |
| CN | 2471440 | Y | 1/2002 | | |
| CN | 101643881 | A * | 2/2010 | C21D 1/26 | |
| CN | 101812571 | A | 8/2010 | | |
| CN | 102373366 | A * | 3/2012 | C21D 8/12 | |
| CN | WO 2012024939 | A1 * | 3/2012 | | |
| EP | 1510591 | A2 * | 3/2005 | C21D 6/002 | |
| JP | 55128530 | A * | 10/1980 | C21D 1/76 | |
| JP | 55138024 | A * | 10/1980 | | |
| JP | 56013430 | A * | 2/1981 | C21D 1/76 | |
| JP | 61190056 | A * | 8/1986 | | |
| JP | 62-120427 | A | 6/1987 | | |

(Continued)

OTHER PUBLICATIONS

Machine translation of CN101760607A (no date available).*

(Continued)

*Primary Examiner* — Kiley Stoner
(74) *Attorney, Agent, or Firm* — Eversheds Sutherland (US) LLP

(57) ABSTRACT

A method for producing a silicon steel normalizing substrate comprises: steelmaking, hot rolling and normalizing steps. The normalizing step uses a normalizing furnace having a nonoxidizing heating furnace section. The nonoxidizing heating furnace section comprises more than 3 furnace zones. An energy investment ratio of the furnace zones used in the nonoxidizing heating furnace section is adjusted, so as to control an excess coefficient $\alpha$ of the nonoxidizing heating furnace section to be within a range of $0.8 \leq \alpha < 1.0$.

13 Claims, 2 Drawing Sheets

(56) References Cited

U.S. PATENT DOCUMENTS

| | | | | |
|---|---|---|---|---|
| 2002/0038678 | A1* | 4/2002 | Ushigami | C21D 8/1255<br>148/113 |
| 2007/0181230 | A1* | 8/2007 | Dessis | C21D 1/26<br>148/575 |
| 2013/0029054 | A1* | 1/2013 | Malloy | C23G 3/02<br>427/444 |
| 2013/0292006 | A1* | 11/2013 | Takahashi | C21D 8/1277<br>148/208 |
| 2016/0167148 | A1* | 6/2016 | Oyama | B23K 1/015<br>228/234.2 |

FOREIGN PATENT DOCUMENTS

| | | | | |
|---|---|---|---|---|
| JP | 02030720 | A | * | 2/1990 |
| JP | 2-149622 | A | | 6/1990 |
| JP | 5-202419 | A | | 8/1993 |
| JP | 10306328 | A | * | 11/1998 |

OTHER PUBLICATIONS

Machine translation of CN101812571A (no date available).*
PCT International Search Report for PCT Application No. PCT/CN2012/000367 dated Dec. 20, 2012 (5 pages).
Lu et al., "Application of the Digital Pulse Combustion Control System in the Cold Strip Annealing Furnace," Bao-Steel Technology, 2010, 1:76-80.

* cited by examiner

| Location | | NOF4 | | | | | | | | | |
|---|---|---|---|---|---|---|---|---|---|---|---|
| Operation side | Top | ● | | ● | | ● | | ● | | ● | |
| | Bottom | | ● | | ● | | ● | | ○ | | ○ |
| | State | ✓ | ✓ | ✓ | ✗ | ✓ | ✓ | ✓ | ✗ | ✓ | ✗ |
| Drive side | Top | | ○ | | ● | | ○ | | ● | | ○ |
| | Bottom | ● | | ● | | ● | | ● | | ● | |
| | State | ✓ | ✗ | ✓ | ✓ | ✓ | ✗ | ✓ | ✓ | ✓ | ✗ |

Figure 2

METHOD FOR PRODUCING SILICON STEEL NORMALIZING SUBSTRATE

CROSS REFERENCE TO RELATED APPLICATIONS

This application claims the priority benefit of PCT/CN2012/000367 filed on Mar. 26, 2012 and Chinese Application No. 201210062502.8 filed on Mar. 9, 2012. The contents of these applications are hereby incorporated by reference in their entirety.

FIELD OF THE INVENTION

The present invention relates to a method for producing high-quality normalized silicon steel substrates.

BACKGROUND OF THE INVENTION

The production of non-oriented electrical steel both at home and abroad has gradually entered into the era of excess capacity, and low-grade oriented silicon steel products have also stepped into the stage of saturation. In order to secure the products a place in the fierce competition in the market, it is of great significance to continue to achieve product quality upgrade, or continue to reduce production cost. The production methods for silicon steel include steelmaking, hot rolling, normalizing, acid pickling, cold rolling and subsequent annealing. Non-oriented silicon steel is often subject to normalizing treatment for the purpose of obtaining a coarse and large grain structure for the hot rolled sheet before cold rolling, so as to achieve a high-strength 0vw texture for the cold-rolled sheet upon annealing. The normalizing of oriented silicon steel products is aimed at adjusting the grain size and texture, realizing hard-phase control, generating free C and N, precipitating ALN and so on.

If the normalizing process is not properly controlled, that is, in the actual production process, if the energy input rate is not effectively controlled, the excess coefficient won't realize the stable control of <1.0, and the actual excess coefficient will be >1.0. As a result, there will be excess oxygen concentrated locally in the furnace, and the reducing atmosphere won't be maintained in the whole non-oxidation heating furnace section. The local excess oxygen will react with Si, Al, Mn, etc., and form on the substrate surface a layer of hardly removable dense oxides constituted of Si, Al, Mn, etc. These oxides adhering to the surface of the substrate will be extremely difficult to be removed in the subsequent shot blasting and acid pickling treatment. After cold rolling, dustlike point and strip-shaped hand feeling-free matters will be found attached locally or entirely across its width on the surface of the rolled hard sheet.

Japan is a world leader in terms of silicon steel production technology level. For example, the Japanese laid-open Patent Publication SHO 48-19048 focused on how to strengthen the acid pickling treatment to remove the dense oxides already produced as much as possible. Domestic published literature, Electrical Steel edited by He Zhongzhi, also discloses how to eliminate the oxides attached on the substrate surface. The specific descriptions are as follows: subject the annealed steel sheet to acid pickling treatment in concentrated hydrochloric acid containing 10% HF or 1~2% HF +6% $HNO_3$ at 70° C., or subject it to $H_3PO_4$ +HF chemical polishing or electrolytic polishing. After complete removal of attached oxides, subject the substrate to subsequent treatment, and the iron loss of the finished silicon steel products will be significantly reduced.

The above literature all propose the strengthening of acid pickling treatment to remove dense oxides on the substrate surface in the steps following normalizing, but they are only follow-up remedial measures. There are usually such problems as complicated process and increased cost in subsequent steps after normalizing. Therefore, efforts are still expected to be made to prevent the formation of dense oxides in the normalizing treatment process.

SUMMARY OF THE INVENTION

The object of the present invention is to provide a method for producing high-quality normalized silicon steel substrates. "High quality" means that, after normalizing treatment by this method, no dense oxides that cannot be removed by subsequent acid pickling are produced on the substrate. The method of the present invention can successfully prevent the formation of dense oxides in the normalizing treatment process, and improve the quality of normalized silicon steel substrate. By the method of the present invention, the steps following normalizing are simplified and the cost is reduced.

The present invention provides a method for producing normalized silicon steel substrates, including steps of steelmaking, hot rolling and normalizing, wherein a normalizing furnace comprising a non-oxidation heating furnace section being used in the normalizing step, the non-oxidation heating furnace section comprising three or more furnace zones, characterized in that an energy input rate of furnace zones used in said non-oxidation heating furnace section is adjusted to control an excess coefficient $\alpha$ of said non-oxidation heating furnace section within the range of $0.8 \leq \alpha < 1.0$, wherein the energy input rate is the ratio of the actual combustion load power of nozzles used in a furnace zone to the full load power of nozzles used in the furnace zone, and the excess coefficient is the ratio of the actual air amount for combustion to the theoretical air amount for combustion.

In the method of the present invention, the energy input rate of furnace zones used in said non-oxidation heating furnace section is adjusted to the range of 15%~95%.

In the method of the present invention, the energy input rate of said furnace zones used is adjusted by closing at least one furnace zone of said non-oxidation heating furnace section.

In the method of the present invention, the energy input rate of said furnace zones used is adjusted by adjusting the number of nozzles in service in the furnace zones used in said non-oxidation heating furnace section.

In the method of the present invention, the energy input rate of said furnace zones used is adjusted by adjusting the heating rate in the heating process of said non-oxidation heating furnace section.

The method of the present invention can successfully prevent the formation of dense oxides in the normalizing treatment process, and improve the quality of normalized silicon steel substrate. By the method of the present invention, the steps following normalizing are simplified and the cost is reduced.

BRIEF DESCRIPTION OF THE DRAWINGS

FIG. 2 provides the schematic diagram of the input and closing of nozzles in the fourth furnace zone (NOF4) used in the non-oxidation heating furnace section of the normalizing furnace, wherein the nozzles are distributed on the top or at the bottom of the operation side or drive side of the normalizing furnace, √ represents the input of a nozzle, while x represents the closing of a nozzle.

DETAILED DESCRIPTION OF THE INVENTION

Figure 1:
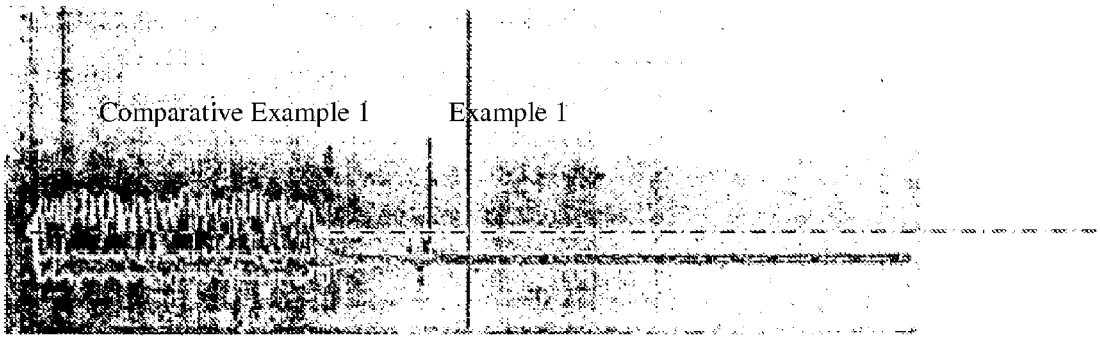
FIG. 1 describes the influence of the energy input rate of furnace zones in the non-oxidation heating furnace section of the normalizing furnace on the actual excess coefficient.

In conjunction with the following figures and examples, the method of the present invention is specifically described below, but the present invention is not limited thereto.

The production method of the normalized silicon steel substrate includes steps of steelmaking, hot rolling and normalizing In the normalizing step, a normalizing furnace comprises sequentially, along the running direction of the strip steel, preheating section, non-oxidation heating section, tunnel seal (furnace chamber height abruptly reduced), multiple subsequent normalizing treatment sections, and exit sealing device. In order to precisely control the temperature rise of the non-oxidation heating furnace, the non-oxidation heating furnace section may include two furnace zones, and preferentially include three furnace zones. Wherein, the multiple subsequent normalizing treatment furnace sections include at least one furnace section selected from radiant tube heating/cooling section, electric/radiant tube soaking section and radiant tube/water jacket cooling section, and said multiple subsequent normalizing treatment furnace sections are arranged in a random sequence. The heating before tunnel seal is non-oxidation heating by direct flame combustion, and the protective gas of $N_2$ is charged between tunnel seal and exit sealing device (including tunnel seal and exit sealing device). The functions of the normalizing furnace include preheating, heating, soaking and cooling.

The present invention, by adjusting the energy input rate (heating load) of furnace zones used in the non-oxidation heating furnace section, controls the excess coefficient $\alpha$ of the non-oxidation heating furnace section within the range of $0.8 \leq \alpha < 1.0$, realizes stable combustion in a reducing atmosphere, completely cuts off the source of oxygen necessary for the formation of dense oxides, and improves the quality of normalized silicon steel substrates. The weight percentages of the main elements of silicon steel are described as below: $0.5 \leq Si \leq 6.5\%$, $0.05 \leq Mn \leq 0.55\%$, $0.05 \leq Al \leq 0.7\%$, $C \leq 0.05\%$, $P \leq 0.03\%$, $S \leq 0.03\%$, and balance being Fe and some unavoidable impurity elements. This is just a general chemical composition of silicon steel, and the present invention is not limited thereto and can also include other chemical components.

The energy input rate is the ratio of the actual combustion load power of nozzles used in a furnace zone to the full load power of nozzles used in the furnace zone, and the excess coefficient is the ratio of the actual air amount for combustion to the theoretical air amount for combustion. Under a certain combustion load, the nozzles of the non-oxidation heating furnace section generally have a stable combustion capacity with the excess coefficient set between 0.80 and 1.0. The inventor has found through the present study that, as for large-sized normalizing heating furnaces, the stable control of the actual excess coefficient relates not only to nozzles themselves, but also to the specific structure of the furnace and the layout of nozzles.

The aim of controlling the energy input rate is to ensure the combustion of nozzles under the optimal energy input rate and realize stable combustion under a excess coefficient of 0.8~1.0 in the production process. When the burning smoke comes into contact with the strip steel, the air and fuel have got complete combustion, and there is no excess oxygen. In the case of an inappropriate energy input rate, although the excess coefficient is set between 0.8 and 1.0, the actual excess coefficient will be greater than 1, and there will be excess oxygen locally inside the furnace chamber, which means that there will be the oxygen for the formation of dense oxides and that the reducing atmosphere inside the whole furnace chamber will not be maintained. For example, when the energy input rate of furnace zones used in the non-oxidation heating furnace section is lower than 15%, the air flow disturbance inside the furnace is increased, the load requirement for the stable combustion of nozzles can not be met, the combustion of coal gas is inadequate, and there will be excess oxygen locally. When the energy input rate of furnace zones used in the non-oxidation heating furnace section is greater than 95%, the flow regulating valve (especially the butterfly valve) enters into an insensitive regulation zone, the flow control becomes unstable, finally it is impossible to realize the control of the excess coefficient, and there will be severe excess oxygen locally in the non-oxidation heating furnace section. In order to avoid local excess oxygen in the furnace section caused by the above two circumstances, the energy input rate of furnace zones used in the non-oxidation heating furnace section must be controlled between 15% and 95%, so as to control the excess coefficient $\alpha$ of the non-oxidation heating furnace section within the range of $0.8 \leq \alpha < 1.0$, finally ensure the reducing atmosphere of the whole furnace section, completely cut off the source of oxygen necessary for the formation of dense oxides, produce high-quality normalized silicon steel substrates, and manufacture high-quality finished silicon steel products through shot blasting, acid pickling, cold rolling and subsequent annealing.

The energy input rate of furnace zones used may be adjusted by closing at least one furnace zone of said non-oxidation heating furnace section. Closing a certain furnace zone of the non-oxidation heating furnace section means to completely shut off all the valves of the furnace zone, so that no air or coal gas may enter into the furnace chamber of the furnace zone of the non-oxidation heating furnace section. Based on its definition, the energy input rate is the ratio of the actual combustion load power of nozzles used in a furnace zone to the full load power of nozzles used in the furnace zone. Since the heat required for the strip steel to be heated from normal temperature to the target set temperature is constant, closing a certain furnace zone means to increase the actual combustion load of other unclosed furnace zones, i.e., to increase the actual combustion load power of nozzles in service in the furnace zones used. Considering that the designed full load power of nozzles in each furnace zone is constant, in this way the energy input rate of the original furnace zone is redistributed to other unclosed furnace zones. Thus, the energy input rate of furnace zones used is adjusted by closing at least one furnace zone of the non-oxidation heating furnace section. Besides, the number of furnace zones to be closed may be determined by the required range of the excess coefficient of the non-oxidation heating furnace section.

On the other hand, the energy input rate of furnace zones used can be adjusted by adjusting the number of nozzles in service in the furnace zones used in said non-oxidation heating furnace section. Based on its definition, the energy input rate is the ratio of the actual combustion load power of nozzles used in a furnace zone to the full load power of nozzles used in the furnace zone. By closing certain nozzles in the furnace zone, the full load power of nozzles used is reduced, and the energy input rate of furnace zones used is hereby adjusted. Thus, the energy input rate of furnace zones used is adjusted by closing at least one nozzle of furnace zones used in the non-oxidation heating furnace section. Besides, the number of nozzles to be closed may be determined by the required range of the excess coefficient of the non-oxidation heating furnace section.

Furthermore, the energy input rate of furnace zones used can be adjusted by adjusting the heating rate in the heating process of the non-oxidation heating furnace section. With the change of the heating rate, the energy input is changed as well, and the energy input rate of furnace zones used is hereby adjusted.

In the method of the present invention, by adjusting the energy input rate (heating load) of furnace zones used in the non-oxidation heating furnace section, the excess coefficient $\alpha$ of the non-oxidation heating furnace section can be controlled within the range of $0.8 \leq \alpha < 1.0$, so as to stably control the reducing atmosphere of the whole non-oxidation heating furnace section, completely cut off the source of oxygen necessary for the formation of dense oxides in the whole furnace section, produce high-quality normalized silicon steel substrates, and manufacture high-quality finished silicon steel products through shot blasting, acid pickling, cold rolling, annealing and coating treatment.

PREPARATION EXAMPLES

Hot rolled steel coil production methods include such steps as steelmaking and hot rolling, as described below:

1) Steelmaking process. It covers converter blowing, RH refining and continuous casting process. Through the above processes, it can strictly control the ingredients, inclusions and microstructure of the products, maintain unavoidable impurities and residual elements in the steel at a relatively low level, reduce the amount of inclusions in the steel and coarsen them, and try to obtain casting slabs of a high equiaxed crystal proportion at a rational cost through a series of steelmaking technology and according to the different categories of products.

2) Hot-rolling process. It covers different steps like heating, rough rolling, finish rolling, laminar cooling and reeling at different temperatures with regard to the steel-grade continuous casting billets designed in Step 1. Relying on the hot rolling process independently developed by Baosteel, it can effectively save energy and obtain high-production and high-quality hot coils with excellent performance which can satisfy the performance and quality requirements on final products. The chemical ingredients of the hot rolled steel coil prepared are described as below: $0.5 \leq Si \leq 6.5\%$, $0.05 \leq Mn \leq 0.55\%$, $0.05 \leq Al \leq 0.7\%$, $C \leq 0.05\%$, $P \leq 0.03\%$, $S \leq 0.03\%$, and balance being Fe and some unavoidable impurity elements.

EXAMPLES

Constituted by C: 0.0074%, Si: 3.24%, Mn: 0.08%, P: 0.005% and S<0.007%, the hot rolled steel coil has gone through normalizing by various methods, and the quality of the product surface after acid pickling and cold rolling is described in Table 1:

TABLE 1

Influence of closing a furnace zone of the non-oxidation heating furnace section on the actual excess coefficient

| | Furnace section | NOF1 | NOF2 | NOF3 | NOF4 | NOF5 | NOF6 | Oxide residue on normalized substrates after acid pickling |
|---|---|---|---|---|---|---|---|---|
| Example 1 | Energy input rate | Closed | Closed | 57.3% | 60.3% | 62.6% | 35.3% | No |
| | Actual excess coefficient | / | / | 0.90~0.94 | 0.90~0.94 | 0.90~0.94 | 0.90~0.94 | |
| Comparative example 1 | Energy input rate | 61.9% | 33.7% | 52.1% | 16.1% | 9.0% | 9.3% | Yes |
| | Actual excess coefficient | 0.88~0.92 | 0.87~0.94 | 0.88~0.92 | 0.87~0.95 | 0.6~1.5 | 0.4~1.6 | |

NOF1~6 refer to the first to the sixth furnace zone in the non-oxidation heating furnace section of the normalizing furnace.

In Comparative Example 1, the energy input rates of the last two furnace zones in the non-oxidation heating furnace section are both lower than 15%, so the excess coefficient $\alpha$ of the last two furnace zones in the non-oxidation heating furnace section cannot be controlled within the range of $0.8 \leq \alpha < 1.0$. In this case, the air flow disturbance inside the furnace is increased, the load requirement for the stable combustion of nozzles cannot be met, the combustion of coal gas is inadequate, and there will be excess oxygen locally, so it is impossible to realize the stable control of the reducing atmosphere and cut off the source of oxygen necessary for the formation of dense oxides. Since the product needs to pass through all the furnace zones, if one furnace zone fails to meet the requirement, there will be oxide residue on normalized substrates after acid pickling.

In Example 1, the first two furnace zones in the non-oxidation heating furnace section are closed, the energy input rates of the other four furnace zones in the non-oxidation heating furnace section are adjusted to fall within the range of 15%~95%, the excess coefficient $\alpha$ of various furnace zones in the non-oxidation heating furnace section is controlled within the range of $0.8 \leq \alpha < 1.0$, so as to stably control the reducing atmosphere of the whole non-oxidation heating furnace section and completely cut off the source of oxygen necessary for the formation of dense oxides in the whole furnace section. In this case, there will be no oxide residue on normalized substrates after acid pickling.

FIG. 1 displays the influence of the energy input rate on the actual excess coefficient in Example 1 and Comparative Example 1. The dotted line represents the line with an excess coefficient of 1. In Example 1, the first two furnace zones in the non-oxidation heating furnace section are closed, the energy input rates of the other four furnace zones in the non-oxidation heating furnace section are adjusted to fall within the range of 15%~95%, the excess coefficient $\alpha$ of various furnace zones in the non-oxidation heating furnace section can be controlled within the range of $0.8 \leq \alpha < 1.0$. In Comparative Example 1, since the energy input rates of the last two furnace zones in the non-oxidation heating furnace section are both lower than 15%, the actual excess coefficient fluctuates significantly, and can not be controlled within the range of $0.8 \leq \alpha < 1.0$.

Constituted by C: 0.0028%, Si: 2.75%, Mn: 0.09%, AL: 0.12%, P: 0.005% and S<0.007%, the hot rolled steel coil has gone through normalizing by various methods, and the quality of the product surface after acid pickling and cold rolling is described in Table 2:

TABLE 2

Influence of adjusting the number of nozzles in the fourth furnace zone (NOF4) in the non-oxidation heating furnace section on the actual excess coefficient

| | Furnace section | NOF1 | NOF2 | NOF3 | NOF4 | NOF5 | NOF6 | Oxide residue on normalized substrates after acid pickling |
|---|---|---|---|---|---|---|---|---|
| Example 2 | Energy input rate | 41.3% | 34.2% | 45.7% | 17.5% | 20.3% | 24.5% | No |
| | Actual excess coefficient | 0.90~0.92 | 0.93~0.95 | 0.94~0.96 | 0.94~0.96 | 0.94~0.96 | 0.94~0.96 | |
| Comparative example 2 | Energy input rate | 41.3% | 34.2% | 45.7% | 12.3% | 35% | 26% | Yes |
| | Actual excess coefficient | 0.90~0.92 | 0.93~0.95 | 0.94~0.96 | 0.56~1.03 | 0.94~0.96 | 0.94~0.96 | |

In Comparative Example 2, the energy input rate of the fourth furnace zone (NOF4) in the non-oxidation heating furnace section is lower than 15%, so the excess coefficient $\alpha$ of the fourth furnace zone (NOF4) in the non-oxidation heating furnace section cannot be controlled within the range of $0.8 \leq \alpha < 1.0$. In this case, the air flow disturbance inside the furnace is increased, the load requirement for the stable combustion of nozzles can not be met, the combustion of coal gas is inadequate, and there will be excess oxygen locally, so it is impossible to realize the stable control of the reducing atmosphere and thus cut off the source of oxygen necessary for the formation of dense oxides. Since the product needs to pass through all the furnace zones, if one furnace zone fails to meet the requirement, there will be oxide residue on normalized substrates after acid pickling.

In Example 2, by closing the nozzles at various locations of the fourth furnace zone (NOF4) in the non-oxidation heating furnace section, (i.e., three nozzles on the operation side and three on the drive side, as shown in FIG. 2), the energy input rate of the fourth furnace zone (NOF4) is adjusted to fall within the range of 15%~95%, the excess coefficient $\alpha$ of the fourth furnace zone (NOF4) is controlled within the range of $0.8 \leq \alpha < 1.0$, so as to stably control the reducing atmosphere of the whole non-oxidation heating furnace section and completely cut off the source of oxygen necessary for the formation of dense oxides in the whole furnace section. In this case, there will be no oxide residue on normalized substrates after acid pickling.

Constituted by C: 0.0074%, Si: 3.24%, Mn: 0.08%, P: 0.005% and S<0.007%, the hot rolled steel coil has gone through normalizing by various methods, and the quality of the product surface after acid pickling and cold rolling is described in Table 3:

TABLE 3

Influence of various heating rates of the non-oxidation heating furnace section on the actual excess coefficient

| | Furnace section | NOF1 | NOF2 | NOF3 | NOF4 | NOF5 | NOF6 | Oxide residue on normalized substrates after acid pickling |
|---|---|---|---|---|---|---|---|---|
| Example 3 | Energy input rate | 29.3% | 34.5% | 45.7% | 28% | 35% | 26% | No |
| | Actual temperature | 800 | 830 | 870 | 890 | 900 | 910 | |
| | Actual excess coefficient | 0.90~0.92 | 0.93~0.95 | 0.94~0.96 | 0.94~0.96 | 0.94~0.96 | 0.94~0.96 | |
| Comparative example 1 | Energy input rate | 61.9% | 33.7% | 52.1% | 16.1% | 9.0% | 9.3% | Yes |
| | Actual temperature | 870 | 880 | 900 | 905 | 910 | 910 | |
| | Actual excess coefficient | 0.88~0.92 | 0.87~0.94 | 0.88~0.92 | 0.87~0.95 | 0.6~1.5 | 0.4~1.6 | |

In Comparative Example 1, the energy input rates of the last two furnace zones in the non-oxidation heating furnace section are both lower than 15%, so the excess coefficient $\alpha$ of the last two furnace zones in the non-oxidation heating furnace section can not be controlled within the range of $0.8 \leq \alpha < 1.0$. In this case, the air flow disturbance inside the furnace is increased, the load requirement for the stable combustion of nozzles can not be met, the combustion of coal gas is inadequate, and there will be excess oxygen locally, so it is impossible to realize the stable control of the reducing atmosphere and cut off the source of oxygen necessary for the formation of dense oxides. Since the product needs to pass through all the furnace zones, if one furnace zone fails to meet the requirement, there will be oxide residue on normalized substrates after acid pickling.

In Example 3, by adjusting the heating rate in the heating process of said non-oxidation heating furnace section, the energy input rate of various furnace zones in the non-oxidation heating furnace section is adjusted to fall within the range of 15%~95%, the excess coefficient $\alpha$ of various furnace zones in the non-oxidation heating furnace section is controlled within the range of $0.8 \leq \alpha < 1.0$, so as to stably control the reducing atmosphere of the whole non-oxidation heating furnace section and completely cut off the source of oxygen necessary for the formation of dense oxides in the whole furnace section. In this case, there will be no oxide residue on normalized substrates after acid pickling.

INDUSTRIAL APPLICABILITY

The method of producing a high quality normalized silicon steel substrate of the present invention can successfully prevent the formation of dense oxides in the normalizing treatment process, and improve the quality of normalized silicon steel substrate. By the method of the present invention, the steps following normalizing are simplified and the cost is reduced, and it can be used for the large-scale production of high-quality normalized silicon steel substrate.

The invention claimed is:

1. A method for producing normalized silicon steel substrates, comprising steps of steelmaking, hot rolling, and normalizing, wherein a normalizing furnace comprising a non-oxidation heating furnace section is used in the normalizing step, and the non-oxidation heating furnace section comprises three or more furnace zones, wherein an energy input rate of any running furnace zones in said non-oxidation heating furnace section is adjusted so that an excess coefficient $\alpha$ of said non-oxidation heating furnace section is controlled within the range of $0.8 \leq \alpha < 1.0$, and wherein the energy input rate is a ratio of the actual combustion load power of running nozzles in a furnace zone to a full load power of running nozzles in said furnace zone, and the excess coefficient is the ratio of an air amount for actual combustion to an air amount for theoretical combustion.

2. The method of claim 1, wherein the energy input rate of said running furnace zones in said non-oxidation heating furnace section is adjusted to be within the range of 15%~95%.

3. The method of claim 1, wherein the energy input rate of said running furnace zones is adjusted by closing at least one furnace zone of said non-oxidation heating furnace section.

4. The method of claim 1, wherein the energy input rate of said running furnace zones is adjusted by adjusting a number of nozzles to be used in the furnace zones put into use in said non-oxidation heating furnace section.

5. The method of claim 1, wherein the energy input rate of said running furnace zones is adjusted by adjusting a heating rate of the heating process of said non-oxidation heating furnace section.

6. A method for producing normalized silicon steel substrates, comprising steps of steelmaking, hot rolling, and normalizing, wherein a normalizing furnace comprising a non-oxidation heating furnace section is used in the normalizing step, and the non-oxidation heating furnace section comprises three or more furnace zones, wherein an energy input rate of the furnace zones used in the non-oxidation heating furnace section is adjusted so that an excess coefficient a of the non-oxidation heating furnace section is controlled within the range of $0.8 \leq \alpha < 1.0$, and further wherein the energy input rate of the furnace zones used is adjusted by closing at least one furnace zone of the non-oxidation heating furnace section, and wherein the energy input rate is a ratio of the actual combustion load power of nozzles used in a furnace zone to a full load power of nozzles used in the furnace zone, and the excess coefficient is the ratio of an air amount for actual combustion to an air amount for theoretical combustion.

7. The method of claim 6, wherein the energy input rate of the running furnace zones in the non-oxidation heating furnace section is adjusted to be within the range of 15%~95%.

8. The method of claim 6, wherein the energy input rate of the running furnace zones is adjusted by adjusting a number of nozzles to be used in the furnace zones in the non-oxidation heating furnace section.

9. The method of claim 6, wherein the energy input rate of the running furnace zones is adjusted by adjusting a heating rate of the heating process of the non-oxidation heating furnace section.

10. A method for producing normalized silicon steel substrates, comprising steps of steelmaking, hot rolling, and normalizing, wherein a normalizing furnace comprising a non-oxidation heating furnace section is used in the normalizing step, and the non-oxidation heating furnace section comprises three or more furnace zones, wherein an energy input rate of the furnace zones used in the non-oxidation heating furnace section is adjusted so that an excess coefficient a of the non-oxidation heating furnace section is controlled within the range of $0.8 \leq \alpha < 1.0$, and further wherein the energy input rate of the furnace zones is adjusted by adjusting a number of nozzles used in the furnace zones, and wherein the energy input rate is a ratio of the actual combustion load power of nozzles used in a furnace zone to a full load power of nozzles used in the furnace zone, and the excess coefficient is the ratio of an air amount for actual combustion to an air amount for theoretical combustion.

11. The method of claim 10, wherein the energy input rate of the running furnace zones in the non-oxidation heating furnace section is adjusted to be within the range of 15%~95%.

12. The method of claim 10, wherein the energy input rate of the running furnace zones is adjusted by closing at least one furnace zone of the non-oxidation heating furnace section.

13. The method of claim 10, wherein the energy input rate of the running furnace zones is adjusted by adjusting a heating rate of the heating process of the non-oxidation heating furnace section.

* * * * *